US005141445A

United States Patent [19]

Little

[11] Patent Number: 5,141,445

[45] Date of Patent: Aug. 25, 1992

[54] SURFACE MOUNTED ELECTRICAL CONNECTOR

[75] Inventor: Philip V. Little, High Wycombe, United Kingdom

[73] Assignee: Thomas & Betts Corporation, Bridgewater, N.J.

[21] Appl. No.: 693,733

[22] Filed: Apr. 30, 1991

[51] Int. Cl.[5] ..... H01R 13/648

[52] U.S. Cl. ..... 439/108; 439/607; 439/79

[58] Field of Search ..... 439/74, 79, 80, 92, 439/95, 101, 108, 607, 608, 609; 29/840, 843

[56] References Cited

U.S. PATENT DOCUMENTS

| | | | |
|---|---|---|---|
| 4,285,561 | 8/1981 | Chow . | |
| 4,418,971 | 12/1983 | Liss . | |
| 4,456,317 | 6/1984 | McCleerey . | |
| 4,522,423 | 11/1985 | Swengel . | |
| 4,655,518 | 4/1987 | Johnson et al. | 439/62 |
| 4,806,109 | 2/1989 | Manabe et al. | 439/108 |
| 4,836,791 | 6/1989 | Grabbe et al. | 439/81 X |
| 4,875,863 | 10/1989 | Reed | 439/81 X |
| 4,992,052 | 2/1991 | Verhoeven | 439/62 |
| 5,035,652 | 7/1991 | Shibano | 439/610 |

FOREIGN PATENT DOCUMENTS

| | | |
|---|---|---|
| 0254385 | 1/1988 | European Pat. Off. . |
| 2329476 | 12/1974 | Fed. Rep. of Germany . |
| 8707444 | 12/1987 | PCT Int'l Appl. . |

OTHER PUBLICATIONS

Clark, William J., "The PCB Connector As a Surface Mounted Device", IEEE Transactions on Components, Hybrids and Mfg. Technology, 1985, pp. 530–534.

*Primary Examiner*—Larry I. Schwartz
*Assistant Examiner*—Khiem Nguyen
*Attorney, Agent, or Firm*—Robert M. Rodrick; Salvatore J. Abbruzzese

[57] ABSTRACT

A shielded electrical connector for surface connection to a printed circuit board comprises an electrically insulative body supporting a plurality of electrical contacts. Each contact includes a first portion for making contact with a complementary contact of a mateable connector when in use, and a second portion adapted to be connected to a surface of a printed circuit board. The connector further includes electrically conductive shielding contact means mounted on the body for shielding or grounding the electrical contacts. The shielding contact means comprises a plurality of electrically connected shielding finger contacts that are adapted to be connected to the printed circuit board surface. As such, when the connector is mounted to the circuit board, the electrical contacts and the finger contacts may be simultaneously connected to conductive pads on the printed circuit board by conventional reflow soldering techniques.

9 Claims, 4 Drawing Sheets

SURFACE MOUNTED ELECTRICAL CONNECTOR

FIELD OF THE INVENTION

The invention relates to electrical connectors, and their manufacture. More particularly, the invention relates to connectors mounted on a substrate, such as a printed circuit board (hereinafter referred to as PCB) where contacts of a connector need to be connected electrically to an electrical circuit present on the PCB.

BACKGROUND OF THE INVENTION

Connection of connector contacts to a circuit present on a PCB is usually achieved either by passing a leg of each contact through a hole in the PCB and then making electrical contact by soldering to a line of the circuit of the PCB present at the respective hole (referred to as "through hole mounted" connector), or by arranging an arm of each contact to lie against a respective desired point of the circuit of the PCB and to solder the contact arms in place (referred to as a "surface mounted" connector). In a surface mounted connector arrangement, a PCB generally has one or more rows of contact positions spaced to be compatible with the spacing of the contact arms of the connector to be surface mounted. A known technique for securing the contact arms to the desired points of the circuit of the PCB has been to use reflow soldering, where the connector is mounted on the PCB in a desired position, and the assembly heated in an oven to fuse each contact arm, by solder provided on the PCB, to the respective circuit. All soldered connections are thus achieved at the same visit to the heated oven.

With contacts being close together, problems can occur with interference, and there is a need for grounding or shielding to be provided between the contacts. This is achieved by providing grounding or shielding contacts. Such shielding or grounding contacts have, in reflow soldered assemblies, hitherto been provided after reflow soldering, using through hole soldering of the grounding or shielding contacts, or press-fit contacts.

SUMMARY OF THE INVENTION

According to the invention there is provided a shielded connector for surface connection to a printed circuit board, which connector comprises a body of electrically insulating material, a multiplicity of electrical contacts, each contact having a first portion for making contact with a contact of a mateable connector, in use, and a second portion adapted to be connected to a surface of a printed circuit board, and electrically conductive shielding contact means mounted on the body for shielding or grounding the electrical contacts, which shielding contact means comprise a plurality of electrically connected shielding finger contacts adapted to be connected to the printed circuit board surface.

Each finger contact of the shielding contact means preferably passes between an associated pair of electrical contacts such that connections between the finger contacts and a printed circuit board, in use, lie nearer the edge of the printed circuit board than connections between the electrical contacts and the printed circuit board.

The connector may comprise hinge means for hingedly engaging the shielding contact means with the body at a location remote from the finger contacts and holding means intermediate the hinge means and free ends of the finger contacts for engaging the body at one or more locations spaced apart from the hinge means to hold together the shielding contact means and the body. The hinge means may comprise a rolled edge portion of the shielding contact means and lip means on the body.

The holding means may comprise tang means engageable with an abutment surface of the body such that, with the hinge means engaged, the holding means operates with a snap-fit once the tang means have moved past the abutment surface.

The electrical connectors are preferably arranged in at least one row and the finger contacts are preferably arranged in a row parallel to the or each row of electrical contacts.

The connector may have two sets of electrical contacts and shielding contact means, one set for contacting one side of a printed circuit board and the other set for contacting the other side of a printed circuit board.

The invention further provides a printed circuit board and a surface mounted connector according to the invention.

The invention further provides a method of surface mounting a shielded connector according to the invention comprising the steps of:

(a) assembling the connector, (b) providing on the printed circuit board solder pads at locations corresponding to the desired locations of the electrical contacts and the finger contacts on the board, (c) engaging the connector with the printed circuit board such that the electrical contacts and the finger contacts lie against respective solder pads, (d) heating the assembled connector and printed circuit board sufficiently to melt the solder, and (e) cooling the assembly to fuse the solder, such that the electrical contacts and the finger contacts are simultaneously connected to the solder pads on the printed circuit board.

The heating step is preferably carried out in an oven.

BRIEF DESCRIPTION OF THE DRAWINGS

By way of example, one embodiment of a connector according to the invention will now be described with reference to the accompanying drawings, in which.

DETAILED DESCRIPTION OF THE PREFERRED EMBODIMENTS

Figure 3:
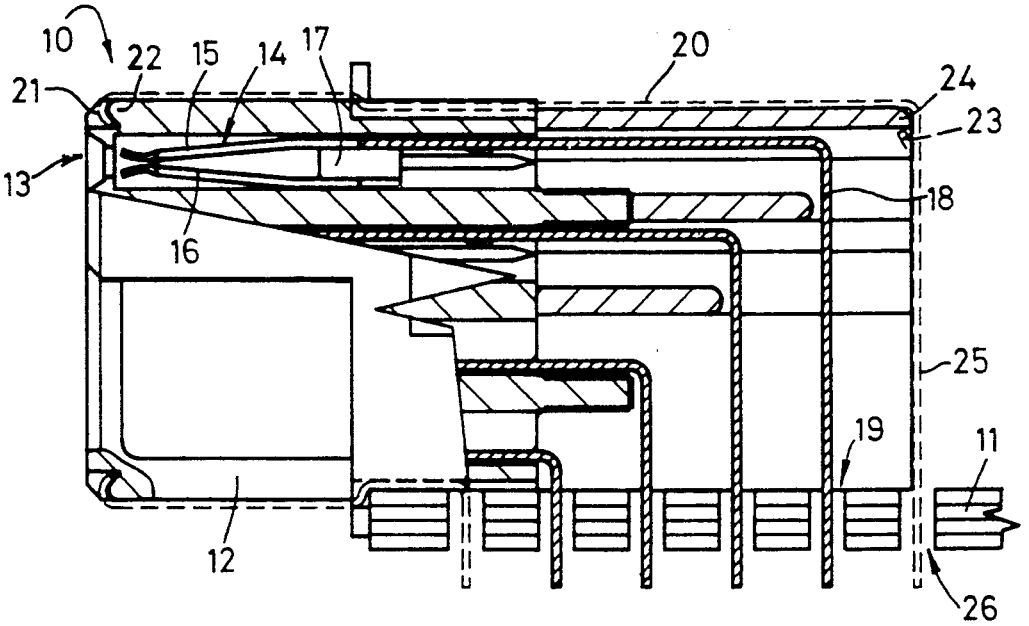
FIG. 3 is a side view, partly in section, of a through hole mounted connector.

FIG. 3 shows a configuration of a through hole mounted female connector 10, mounted on and in contact with a printed circuit board (PCB) 11. The connector 10 has a housing or body 12 moulded of plastic, or of other suitable material, with a set of openings 13 to allow access of contact pins of a male connector (not shown) into the female connector 10.

The connector 10 has a set of female contacts 14 of a conducting material such as metal, and conveniently produced by stamping from a sheet, and then bending to the desired shape. Each contact 14 has a pair of opposed, cantilevered legs 15, 16 extending from a web 17. Also from the web 17 extends a PCB contact limb 18 which extends through a passageway in the body 12 and down to the PCB 11, to pass through a hole 19 and, subsequently, to be soldered to a connection track on the PCB. A shielding or grounding contact 20 (chain lines) of a suitable contact material is located around the outside of the body 12, the contact 20 having a rolled edge 21 locating over a rib 22 in the body 12, and a tang 23 to engage under a lip 24 of the body 12. The contact 20 has limbs 25 which pass through holes 26 in the PCB 11 for soldering to ground tracks on the PCB 11.

Figure 1:
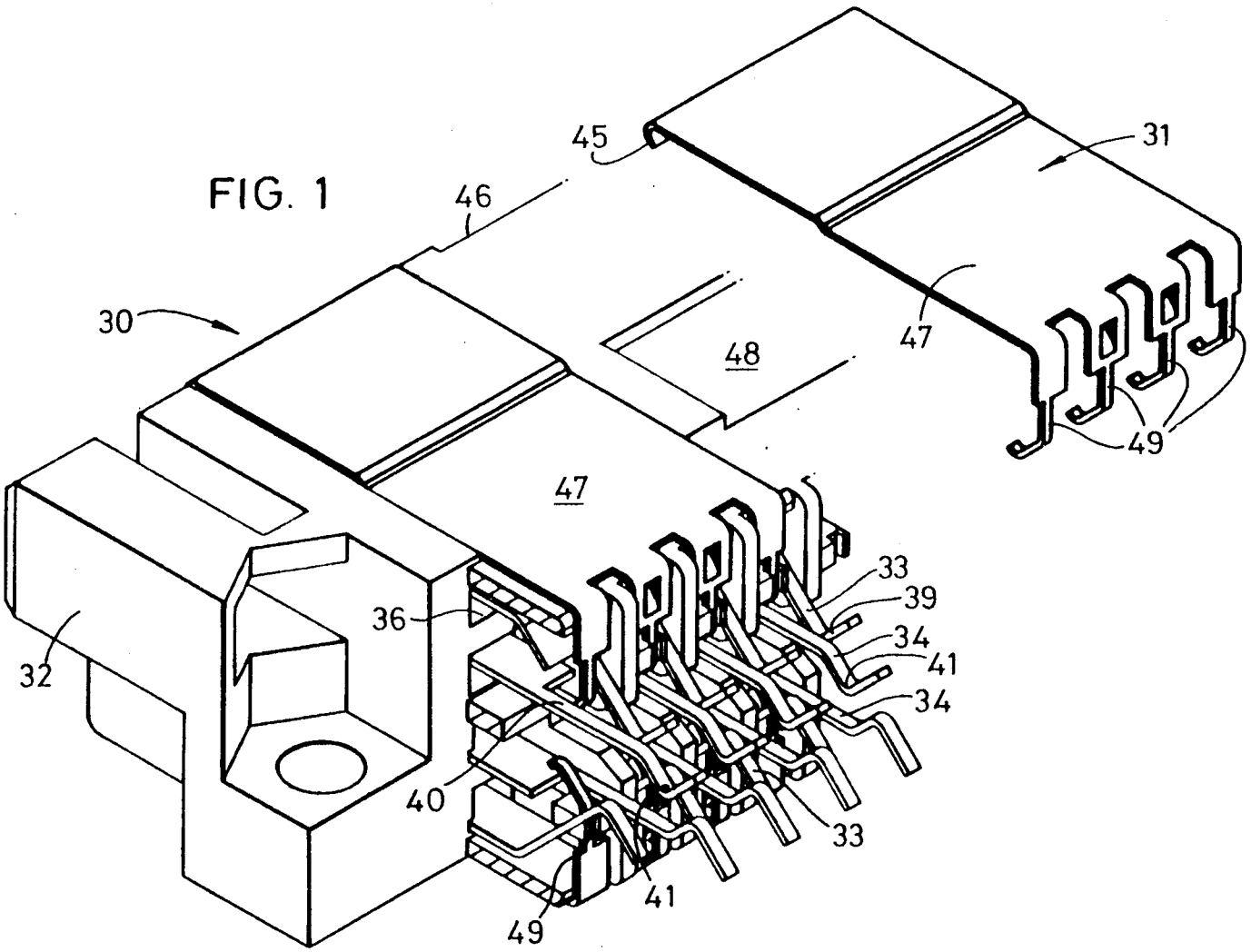
FIG. 1 is a perspective view of a connector according to the invention with a ground contact portion shown separately.
Figure 2:
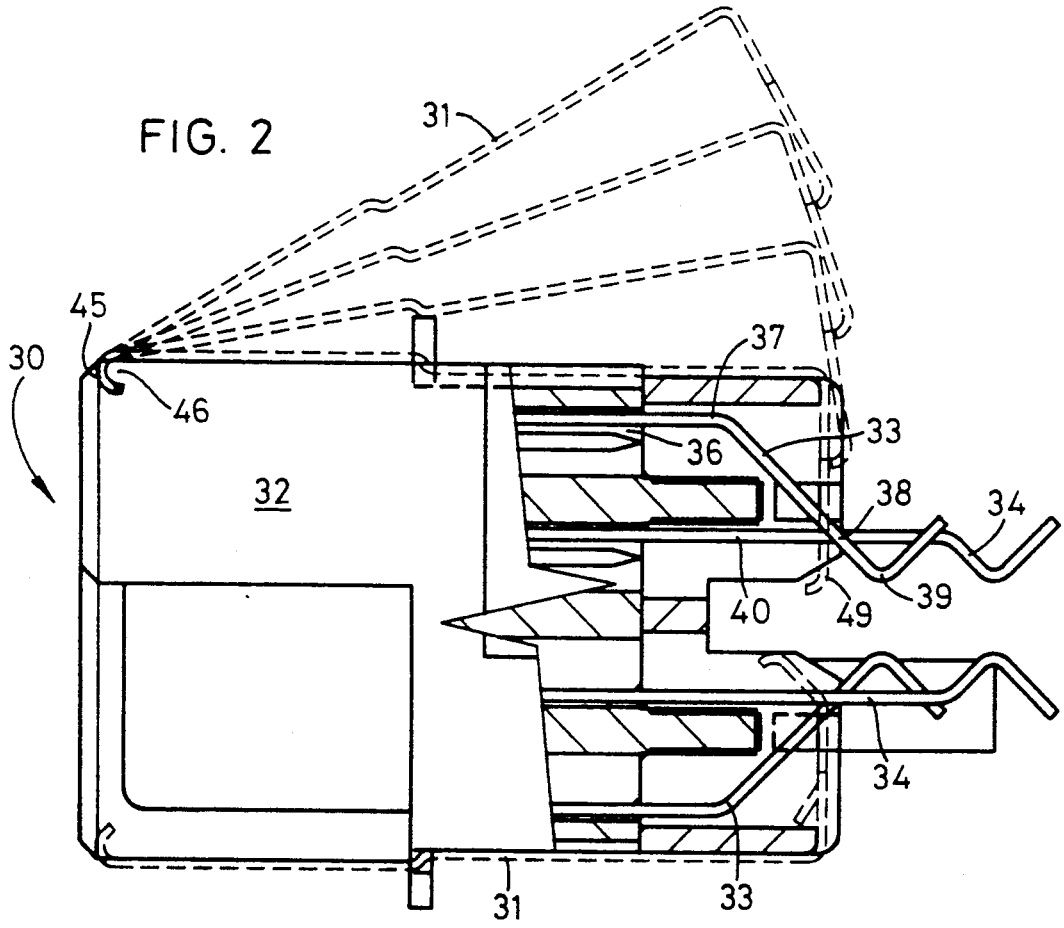
FIG. 2 is a side view, partly in section, of the connector of FIG. 1, illustrating location of the ground contact.
Figure 4:
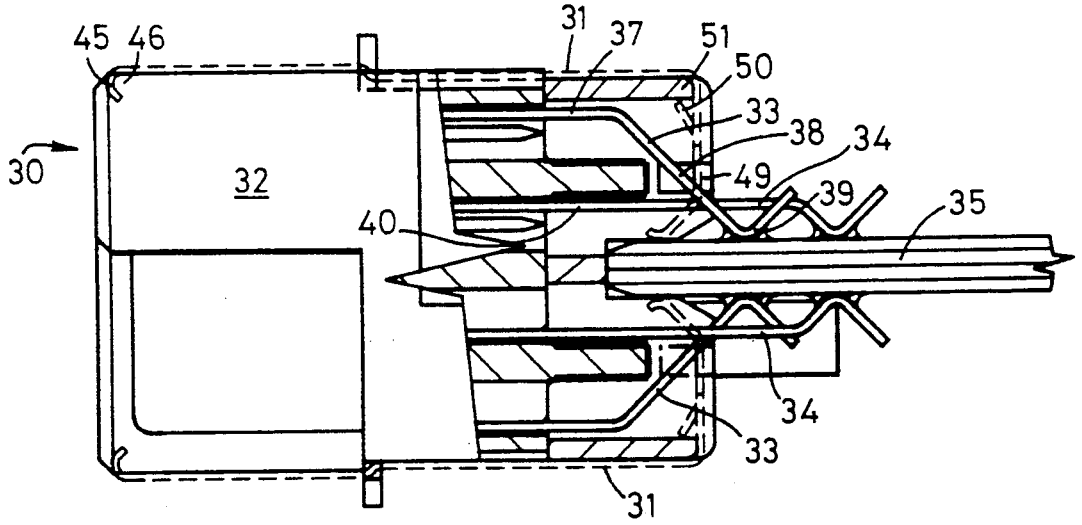
FIG. 4 is a side view, partly in section, of the connector of FIGS. 1 and 2 mounted on a printed circuit board.

FIGS. 1, 2 and 4 show a female connector 30 for surface mounting on a PCB, with a shielding or grounding contact 31. The connector 30 has a body 32 of moulded plastic or other suitable material, the body 32 having recesses (not shown) to allow access to female contact portions (not shown) for male connector pins substantially as described with reference to FIG. 3. Contacts 33, 34 of the connector 30 have socket ends similar to socket ends 15, 16, 17 of the FIG. 3 connector.

The contacts 33 and 34 have different configurations at the ends for attachment to a PCB 35, both types of contact 33 and 34 being of electrically conductive material, such as a metal, and conveniently made by stamping from a sheet of contact material and then bending. The contacts 33 and 34 are configured to have substantially equal contact lengths from the PCB 35 to the female contact portions to minimize any difference in resistance.

The contacts 33 are arranged in the uppermost and lowermost rows in the body 32, and the contacts 34 are arranged in the middle rows in the body 32.

From the web (equivalent to the web 17 of FIG. 3), a contact arm 37 of each contact 33 passes through a passageway 36 in the body 32, the contact arm 37 having a portion 38 extending towards the PCB 35, and a V-shaped end portion 39, the base of the V-shaped end portion 39 of each contact 33 contacting and being soldered to a respective solder pad on the PCB 35 on a track to make a desired connection with the circuit on the PCB 35.

From the web (equivalent to the web 17 of FIG. 3), a contact arm 40 of each contact 34 extends parallel to the PCB 35, in use, the arm 40 of each contact 34 having a V-shaped end portion 41, the base of the V-shaped end portion 41 of each contact 34 contacting and being soldered to a respective pad on the PCB 35 on a track to make a desired connection with the circuit on the PCB 35.

The grounding or shielding contact 31 is of suitable contact material, such as metal, and conveniently formed by stamping from a sheet, and bending. The contact 31 has a rolled edge 45 which engages a lip 46 on the body 32. As shown in FIG. 2, after initial engagement of the rolled edge 45 and the lip 46, the contact 31 is rotated downwardly into its final position. The contact 31 has a planar portion 47 which is located in a recess 48 in the body 32, and finger contacts 49 which extend between the arms 37 and 40 of the contacts 33 and 34 to reach, in use, the PCB 35. A central pair of the finger contacts 49 have tangs 50 pushed out (one tang may be sufficient), which tangs 50 engage a lip 51 on the body with a snap-fit to hold the contact 31 on the body 32. It will be appreciated that the finger contacts could be formed with a hole, and the body moulded with an abutment surface to achieve the same snap-fit effect.

The connector 30 can thus be pre-assembled to the form shown in FIG. 1 before engagement with the PCB 35. The assembled PCB 35 and connector 30 (or, indeed, more than one such connector 30) can be placed in an oven to heat the assembly to solder the contacts 33, 34 and 49 to respective solder pads by using standard surface mounting reflow soldering techniques. Such techniques are well known and will not be described in detail.

Figure 5:
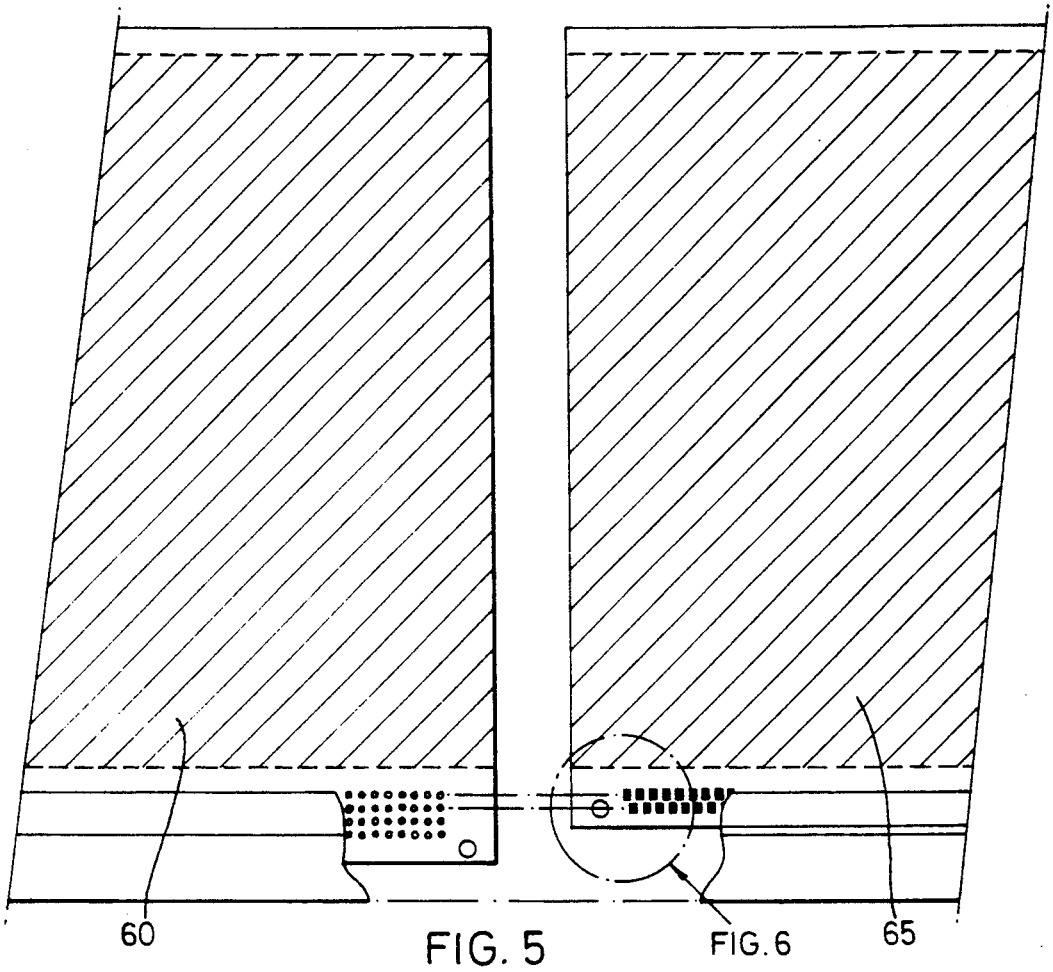
FIG. 5 is a plan view illustrating an edge arrangement of edge contact locations of a PCB for through hole mounted and surface mounted connectors.
Figure 6:
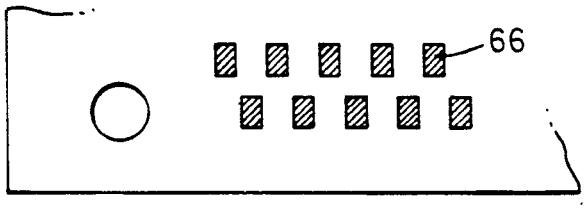
FIG. 6 is a detail of FIG. 5 shown on an enlarged scale.

FIG. 5 shows a comparison of contact positions in a through hole mounted PCB 60 and on one side of a surface mounted PCB 65. This illustrates that the usable surface of the two boards is the same, as indeed is shown in FIGS. 3 and 4. FIG. 6 shows a PCB solder contact pad detail for a PCB with a surface mounted connector without shielding or grounding. The contacts 33 and 34 lie against the pads 66 which, when heated to a requisite temperature, solder the respective contacts to the respective pads.

Figure 7:
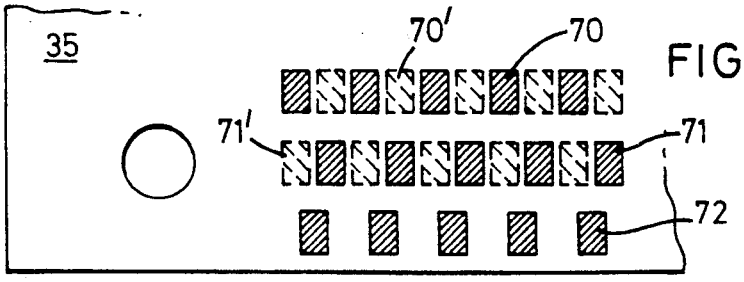
FIG. 7 is a view of a PCB edge portion illustrating contact portions for a grounded or shielded connector as shown in FIGS. 1, 2 and 4.

FIG. 7 shows a plan view of solder pads on the PCB 35 shown in FIG. 4 for use with the connector of FIGS. 1, 2 and 4. On the side of the PCB shown in FIG. 7, there is an inner row of solder pads 70 for attachment to the contacts 34, a second row of solder pads 71 for attachment to the contacts 33, and a third row of solder pads 72 for attachment to grounding or shielding finger contacts 49. The solder pads 72 for ground or shield contacts are applied in corresponding positions above and below the PCB, but the solder pads 70 on one side of the PCB 35 lie between solder pads 70' on the other side of the PCB. Similarly, the solder pads 71 on one side of the PCB 35 lie between solder pads 71' on the other side of the PCB.

This embodiment of a connector (while a female connector has been described mounted on the PCB, it will be appreciated that a male connector could equally well be so mounted) allows a surface mounted connector to be provided with grounding or shielding, in which the connections for the connector contacts and grounding/shielding contacts can be made simultaneously using surface mounting reflow soldering techniques instead of applying a ground contact row after reflow soldering by through hole soldering or press-fit contacts.

The ground contacts are outside the contacts 33, 34 with the PCB, so that grounding paths pass through the signal paths to enhance the grounding or shielding effects, and also allow no extra PCB space to be taken by the shield or grounding contacts.

Various changes to the foregoing described and shown structures would be evident to those skilled in the art. Accordingly, the particularly disclosed invention is intended to be illustrative rather than limiting. The true scope of the invention is set forth in the claims appended hereto.

I claim:

1. A shielded connector for surface connection to a printed circuit board, which connector comprises a body of electrically insulating material, a multiplicity of electrical contacts, each contact having a first portion for making contact with a contact of a mateable connector, in use, and a second portion adapted to be connected to a surface of a printed circuit board, electrically conductive shielding contact means mounted on said body for shielding or grounding said electrical contacts, which shielding contact means comprise a plurality of electrically connected shielding finger contacts adapted to be connected to said printed circuit board surface, and hinge means for hingedly engaging the shielding contact means with the body at a location remote from the finger contacts, said hinge means including a rolled edge portion of the shielding contact means and lip means on said body.

2. A connector as claimed in claim 1 wherein each finger contact of the shielding contact means passes between an associated pair of electrical contacts such that connections between said finger contacts and a printed circuit board, in use, lie nearer an edge of the printed circuit board than connections between the electrical contacts and the printed circuit board.

3. A connector as claimed in claim 2 comprising holding means intermediate the hinge means and free ends of the finger contacts for engaging the body at one or more locations spaced apart form the hinge means to hold together the shielding contact means and the body.

4. A connector as claimed in claim 3 wherein the holding means comprise tang means engageable with an abutment surface of the body such that, with the hinge means engaged, the holding means operates with a snap-fit once the tang means have moved past the abutment surface.

5. A connector as claimed in claim 1 wherein the electrical contacts are arranged in at least one row and the finger contacts are arranged in a row parallel to the or each row of electrical contacts.

6. A connector as claimed in claim 1 comprising two sets of electrical contacts and shielding contact means, one set for contacting one side of a printed circuit board, and the other set for contacting the other side of a printed circuit board.

7. A connector and printed circuit board assembly comprising a printed circuit board and a surface mounted connector as claimed in claim 1.

8. A method of surface mounting a shielded connector as claimed in claim 1 on a printed circuit board, comprising the steps of:

(a) assembling the connector, (b) providing on the printed circuit board solder pads at locations corresponding to the desired locations of the electrical contacts and the finger contacts on the board, (c) engaging the connector with the printed circuit board such that the electrical contacts and the finger contacts lie against respective solder pads, (d) heating the assembled connector and printed circuit board sufficiently to melt the solder, and (e) cooling the assembly to fuse the solder, whereby the electrical contacts and the finger contacts are simultaneously connected to the solder pads on the printed circuit board.

9. A method as claimed in claim 8 wherein the heating step is carried out in an oven.

* * * * *